427-402 SR
2/11/86 OR 4,569,863

United States Patent [19]

Koepke et al.

[11] Patent Number: 4,569,863

[45] Date of Patent: Feb. 11, 1986

[54] PROCESS FOR THE MULTIPLE COATING OF MOVING OBJECTS OR WEBS

[75] Inventors: Günther Koepke, Odenthal; Hans Frenken, Odenthal-Osenau; Heinrich Bussmann; Kurt Browatzki, both of Leverkusen, all of Fed. Rep. of Germany

[73] Assignee: Agfa-Gevaert Aktiengesellschaft, Leverkusen, Fed. Rep. of Germany

[21] Appl. No.: 540,530

[22] Filed: Oct. 11, 1983

[30] Foreign Application Priority Data

Oct. 21, 1982 [DE] Fed. Rep. of Germany ..... 3238905

[51] Int. Cl.[4] ..... B05D 1/30; B05D 1/34

[52] U.S. Cl. ..... 427/402; 427/420; 427/414; 430/935

[58] Field of Search ..... 427/402, 420, 414; 430/935

[56] References Cited

U.S. PATENT DOCUMENTS 4,001,024 1/1977 Dittman et al. ..... 427/420 X
4,041,897 8/1977 Ade ..... 427/420 X
4,384,015 5/1983 Koepke et al. ..... 427/402

FOREIGN PATENT DOCUMENTS 2070459 10/1981 United Kingdom .

*Primary Examiner*—Michael R. Lusignan
*Attorney, Agent, or Firm*—Connolly and Hutz

[57] ABSTRACT

A process for the multiple coating of objects or webs which are continuously moving past a coating point, using coating apparatus according to the curtain coating process. This process is carried out such that any number of comparatively high viscosity layers is embedded between an accelerating layer which is positioned below the layers and has a viscosity range of from 1 to 20 mPas and a layer thickness of from 2 to 30 μm, and a spreading layer which is positioned above the comparatively high viscosity layers and has a viscosity range of from 1 to 10 mPas and a layer thickness of from 5 to 20 μm. By the curtain coating process, coating rates of 400 m/min and more may be achieved with a good coating quality.

12 Claims, 2 Drawing Figures

PROCESS FOR THE MULTIPLE COATING OF MOVING OBJECTS OR WEBS

Figure 1:
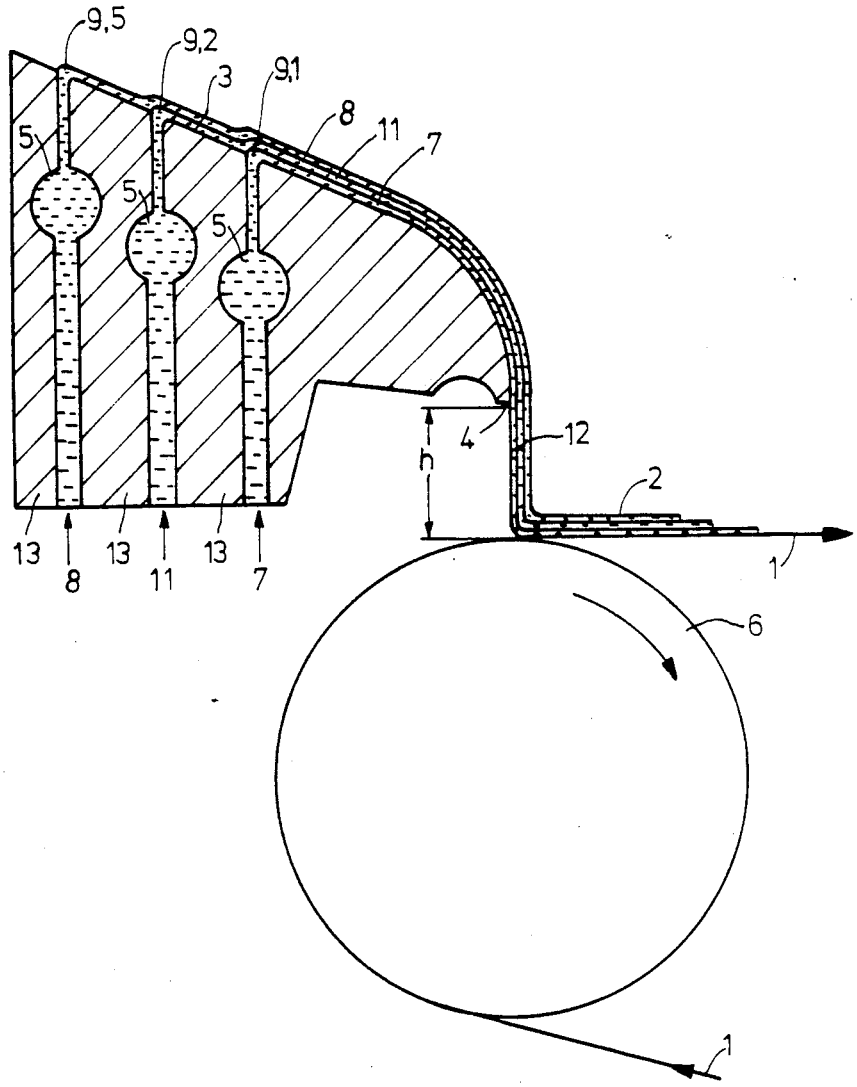

This invention relates to a process for the multiple coating of objects or webs which are continuously moving past a coating point, by means of coating apparatus according to the curtain coating process.

One multilayer process which is of importance to the photographic industry is the cascade coating process, in which one or more layers simultaneously flow down an inclined surface, and are delivered onto a web continuously moving past, across a small spacing between the coating edge and the web. In the literature, this type of process is also termed a "bulge coating process".

Moreover, the importance of the so-called curtain coating process has also been increasing for some time in the photographic industry. Three process variants comprising different casting devices are known for the curtain coating process: the slit caster (extruder type), the beak caster and the V-caster. In the case of the slit caster, the coating composition issues at the lower end of an outflow gap which is located transversely above the web to be coated and forms a free-falling liquid curtain at this point. In the case of the beak or sliding surface caster, the coating compositions are supplied to a downwardly inclined surface via metering gaps and flow down a sliding surface under gravity (which surface is curved or beak-shaped at the lower end) forming a free-falling curtain upon leaving the lower end of the beak. In the case of the V-caster, the coating compositions are supplied to a common coating edge from both sides along two separate sliding surfaces which are arranged so as to form a V-shape, the coating composition flowing down both on and pendent from sliding surfaces, on the way to the coating edge, and form a common free-falling curtain at the coating edge. The V-caster is known from European Pat. No. 0,017,126 and provides considerable advantages, particularly for the photographic industry, which are essentially accounted for by the omission of the discharge lip (beak) and the improved symmetry of the flow conditions associated therewith at the coating edge, over which the compositions flow on both sides and at which the curtain forms. It is surprising that the coating compositions may be supplied to the coating edge, without intermixing pendent from a sliding surface.

Whereas the slit caster which only permits a small number of layers, is not used economically in the photographic industry for the production of colour materials, the beak caster and the V-caster are better suited to the photographic industry because of the possibility of producing a very large number of layers of 12 or more.

Experiments have shown that it is not possible to achieve adequate casting rates using the cascade or bulge coating process according to present day demands. Only relatively low casting rates are achieved in the case of narrowly restricted curtain heights and wet applications even when the curtain coating process is carried out using beak casters under those conditions which are close to practice. When the above-mentioned V-caster is used, the casting rates may be increased compared with the other processes, but the casting rate, in many cases, is still not high enough from an economic point of view. As shown by general experience, a reduction in the casting rate is to be expected, particularly in the case of coating compositions having comparatively high viscosities and when there is a comparatively high solids concentration in the coating compositions. On the other hand, however, high solids concentrations and the high viscosities associated therewith, are advantageous in that the quantity of water to be removed by drying is reduced and drying energy is saved, so that the installation may function in a more financially favourable manner. Last but not least, comparatively high viscosities also produce better casting qualities, because they avoid a reduction in the good casting quality achieved at the casting point during hardening and drying.

Therefore, attempts have been made to overcome these disadvantages and to achieve a high casting rate in the case of high viscosities. DE-A No. 2,712, 055 describes a bulge coating process, in which a bottom layer having a low viscosity and a low moisture coating is applied below a layer which has a higher viscosity and a greater layer thickness. Any package of layers may then be built up on these two lower layers. It is a requirement that the two lower layers are composed of the same materials, or of such materials that they do not exhibit any photographic effects when they are mixed together. In addition, the mixing of these layers is required during casting. According to the description, the viscosity of the first layer should be in the range of from 1 to 10 mPas, the viscosity of the second layer should be in the range of from 10 to 100 mPas, and the layer thickness of the first layer should be in the range of from 2 to 12 micrometers, and that of the second layer should be in the range of from 15 to 30 micrometers. In this process, the mixing of the two layers caused by whirl formation in the meniscus is a disadvantage, giving rise to possible defects in the photographic layer. Another restriction caused by the process arises from the requirement that the first and second layers be made either of the same material or of materials which do not cause any photographic effects. When this process is applied, only rates of up to 3.55 m/s which corresponds to 210 m/min, are achieved.

The Publication DE-A No. 2,820,708 refers to the disadvantages of the process disclosed in the abovementioned DE-A No. 2,712,055, referring, in particular, to the fact that in the case of a very low viscosity, the layers readily become unstable. This instability may be prevented to a certain extent by the application of a reduced pressure below the bulge between the caster and the web, but these instabilities restrict the speed of the web. Thus, this publication proposes the selection of a material for the lower layer which is normally of a high viscosity but which becomes thinly liquid and of a low viscosity under a shearing strain and thus has the required low viscosity only in the critical coating region in the bulge. However, this process requires a particular selection of material for the lowest layer which is not always compatible with the photographic purpose of the complete layer structure.

British Pat. No. 2,070,459 describes another process which establishes the mutual ratio of the viscosities of the first and second layers within narrow limits. Thus, the viscosities of the layers should have the ratio $\eta_1=(0.9-1.1)\eta_2$, and moreover, these viscosities should change in a different manner under the influence of shearing forces, such that the viscosity of the first layer is reduced by more than that of the second layer. There is no free choice of the layer composition in this process either.

An object of the present invention is to provide a process of the initially mentioned type, with which it is easily possible to achieve a high coating rate, without the layers mixing together or the choice of the substances for the layer structure being restricted, and in which the photographically active layer package comprises layers which have a high proportion of solids and a high viscosity, and thereby making possible, a particularly low moisture application and a curtailment of the drying time.

Proceeding from a process of the initially-mentioned type, the object is achieved according to the present invention in that any number of comparatively high viscosity layers is embedded between an accelerating layer which is positioned below the layers and has a viscosity range of from 1 to 20 mPas and a layer thickness of from 2 to 30 μm, and a spreading layer which is positioned above the comparatively high viscosity layers and has a viscosity range of from 1 to 10 mPas and a layer thickness of from 5 to 20 μm.

The lower, low viscosity, so-called accelerating layer flows between the photographically active layer package and the coating apparatus or on one side of the curtain and forms the joinder between the layer package and the objects or webs to be coated which move continuously past the coating point. The so-called spreading layer which is also of a low viscosity, is applied as the uppermost layer to the layer package and covers the layer package during its formation, in a free fall, during coating and after coating.

This type of method allows the use in the layer package of high viscosity solutions having a high solids content and thus a low layer thickness at high casting rates, and thus, makes it possible to save energy in the drying installation.

Surprisingly, it has been found that the combination of an accelerating layer and a spreading layer allows an outstanding casting quality with layer packages which would not otherwise be cast or would only be cast at low coating rates. The layers do not intermix and thus, there is also no impairment of the casting quality. It is also surprising that this accelerating layer may be adjusted so that it is sufficiently thin with respect to layer thickness and viscosity that disadvantageous consequences do not occur in the further operations, such as during hardening of the layers. It is also surprising that by the use of a thin, low viscosity spreading layer, high viscosity layer packages which tend to contract may be spread without fault. However, it is particularly surprising that when a combination of an accelerating and a spreading layer is used with the curtain coating process in the case of high viscosities, casting rates of 400 m/min (6–7 m/s) and more may be achieved.

This behaviour may perhaps be explained as follows.

The forces which occur during impact with the moving objects or webs are absorbed by the accelerating layer, or they only become effective in a delayed manner. The good casting quality may also be explained by this effect, because the layer package which determines the quality of the photographic material, is not adversely affected as regards quality by any influences during contact with the web.

Since the accelerating layer and the spreading layer do not mix with the photographic layers in the curtain coating process, it is possible to select freely the composition of the layers, i.e., any polymer solutions may be used, for example gelatine, cellulose derivatives, polysaccharides or, in certain cases, wetting agent solutions. The layer thickness of these solutions may be advantageously selected so that the layer package—in the case of photographic materials, the photographically active emulsion layers—is/are not adversely influenced.

In a preferred embodiment of the present process, an accelerating layer having a viscosity of from 2 to 10 mPa.s, preferably from 2 to 3 mPas, and a layer thickness of from 2.5 to 10 μm, in particular from 2.5 to 5 μm, is therefore selected.

The effect of the spreading layer may be explained as follows. High viscosity casting solutions have the property of contracting under the influence of the surface tension. This tendency may be reduced by the thin spreading layer.

Thus, an unstable viscous film of several layers is obviously stabilized by two thin layers which shield it from the air.

The castability of high viscosity gelatine solutions or layer package having the combination according to the present invention of an accelerating layer and a spreading layer at coating rates of 400 m/min and more and with curtain heights of, for example, only 15 mm is completely unforeseeable to a man skilled in the art. The V-caster according to European Pat. No. 0 017 126 is optimally suitable for this process and for the application of the accelerating layer required thereby.

With the present process, it is possible in a curtain coating procedure and when the spreading layer and the accelerating layer are used, to select a curtain height between the coating edge and the surface of the object to be coated, of from 10 to 100 mm and preferably from 15 to 50 mm, so that the curtain does not flutter, and the conventional protection devices for protecting the curtain are unnecessary.

Particularly high coating rates with a good casting quality are achieved with the V-caster in that the layer package over which the spreading layer is cast, is supplied on one side of the V-shaped caster block, and the accelerating layer is supplied on the other side, so that the accelerating layer is only combined with the layer package at the casting edge during the formation of the free-falling curtain.

The process for the production of multilayered coatings by means of an accelerating layer and a spreading layer will now be described in more detail in the following with reference to the drawings, using the example of a coating of photographic materials.

Figure 2:
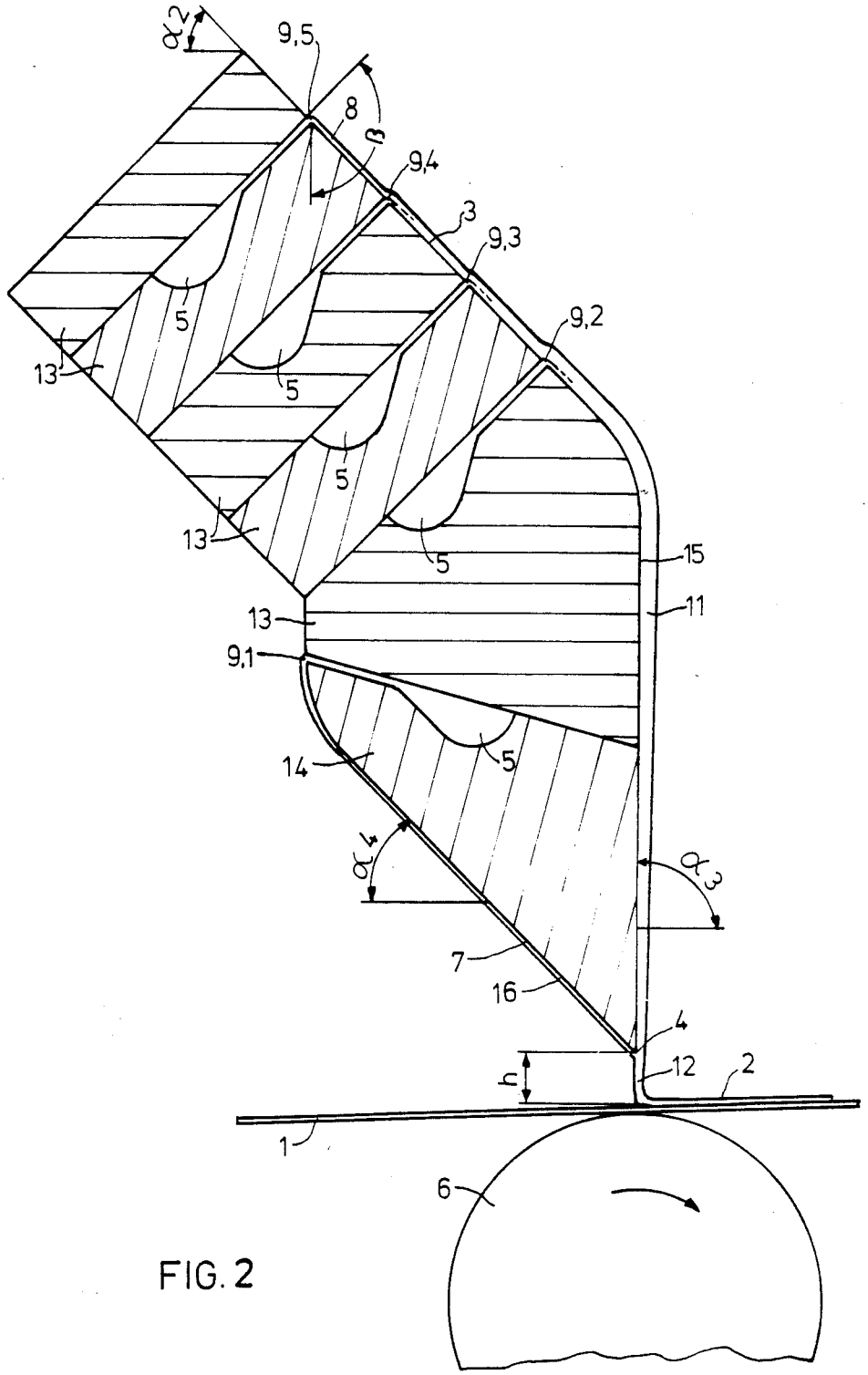

FIG. 1 illustrates a section through a beak caster for carrying out the curtain coating process, and FIG. 2 illustrates a section through a V-caster for carrying out the curtain coating process.

FIG. 1 is a simplified schematic view which illustrates a known beak caster for the curtain coating process for only one high viscosity layer 11 which is embedded between an accelerating layer 7 and a spreading layer 8. The coating liquids 7, 8, 11 are supplied from the outside to distributor chambers 5 (arrows), and issue from outlet slits 9.1, 9.2 and 9.5 onto an inclined surfaces 3 flowing over one another under gravity towards the beak-shaped caster edge 4. A curtain 12 which forms at the caster edge 4, falls freely through a height h and is deposited on a web 1 which is advanced by a casting roller 6. The accelerating layer 7 greatly facilitates the separation of the layer package 8, 11 from the caster edge 4 and causes a good wetting of the web 1, so that coating may be effected at comparatively high speeds and the quality of the coating 2 is improved. The spreading layer 8 shields the high viscosity layer 11 from external influences and stabilizes and smooths to a considerable extent the free-falling liquid curtain 12.

FIG. 2 illustrates a section through a curtain coating apparatus of the V-caster type. The caster comprises blocks 13 and 14 which are screwed together and are restricted by front plates. The front plates and the attachment device of the caster to a frame are not shown. The liquid coating materials 11, 8 are delivered from one front side into the distributor chambers 5 by means of known metering devices and lines which are not described here in more detail. The distributor chambers 5, which may also be of a multistage design, ensure a regular distribution of the coating materials 8, 11 over the complete casting width, in conjunction with the subsequent outlet slits 9.2 to 9.5. The distributor chambers 5 may be equipped with distributor pipes and/or with different supply channels which are accordingly dimensioned over the width.

The coating materials 8, 11 issue from the outlet slits 9.2 to 9.5 and flow down the roof-shaped surfaces 3 under gravity at an angle $\alpha_2$ and lie on top of the materials from the lower outlet slits which are already flowing downwards. The spreading layer 8 is supplied from the uppermost slit 9.5 and flows down over the photographically active layers issuing from the outlet slits 9.2 to 9.4. The spreading layer 8 lying on the layer package 11 guarantees that the layer package is in a perfectly spread condition by preventing the formation of a boundary surface between the high viscosity layers and the air. The layer package 11 flows together with the spreading layer 8, over a vertical surface 15 to the lowest V-shaped caster block 14 and to the coating or caster edge 4.

An accelerating layer 7 is supplied to the distributor chamber 5 between the casting blocks 13 and 14 and issues through the outlet slit 9.1 onto a sliding surface 16 which is inclined negatively at an angle $\alpha_4$. It follows the sliding surface 16 and flows from this other side of the casting block 14 to the common coating edge 4. The free-falling curtain 12 is formed at the coating edge 4 from the first-mentioned layer package, the spreading layer 8 and the accelerating layer 7, and the curtain 12 reaches the web 1 to be coated in fractions of a second over the height h and comes to lie on the moving web 1. During this procedure, the photographically active layer package is sandwiched between the protecting spreading layer 8 and the accelerating layer 7. The web 1 is supported by the casting roller 6 in the region of impact of the curtain 12, and the edges of the curtain are held in a known manner by curtain guides (not shown).

The curtain 12 coats the web 1 over the complete width thereof, and the excess casting material may be collected at the edges by collecting troughs and diverted. In this manner, webs are produced without a peripheral section, which are coated over their complete width with photographic emulsion and are without a peripheral bulge.

However, the web 1 is advantagouesly coated only almost up to its edges, the curtain 12, as is known, being guided by curtain guide elements which extend almost to the moving web, and is thus prevented from contracting under surface tension. In this manner, less valuable coating material is lost. The cast web 1 with the coating 2, is then not cast over its complete width and has to be cut, the uncast edges and the peripheral bulges being separated.

Thus considerable and surprising advantage of the process according to the present invention lies, where curtain casting is concerned, in the unexpected increase in the casting rates for high viscosity coating materials 11. It is particularly remarkable for the curtain caster that even a curtain height h of, for example, 15 mm is sufficient for a high-grade coating. At the low curtain height h, a particular screening of the curtain from fluttering under air movement is often no longer necessary, thus saving costs and improving the accessibility to the curtain. Moreover, the process according to the present invention increases the stability of the curtain, in that no instabilities occur due to the use of the accelerating layer 8 at the discharge edge 4 of the curtain caster, and the photographic layers 11 of the curtain may be composed of high viscosity solutions. Due to the low fall height, the constriction of the curtain caused by the curtain holders which are usually inclined obliquely inwards, and the peripheral thickenings of the curtain 12 are reduced, thereby considerably reducing the losses in the peripheral region of the web 1 during coating. Furthermore, it has surprisingly been found that surface-active substances are no longer necessary in the photographically active coating materials 11, thereby allowing financial savings to be made.

Even the accelerating layer 7 and the spreading layer 8 only require small quantities of surface-active substances. In certain cases, even these layers may be used without surface-active substances.

By this process, all conceivable objects may be coated with a plurality of, for example, 12 or more, layers using the most varied coating materials when the objects are conveyed through, below the coating apparatus.

In principle, the process of the present invention may be used for coating paper, metal, plastics, glass, wood and textiles. Likewise, cohesive webs as well as substrates in the form of sheets, may be coated. As already mentioned, the process is particularly suitable for casting photographic substrates with photographic layers or other dye and lacquer layers.

All conventional web-shaped materials may be used for the production of photographic materials, for example film webs of cellulose nitrate, cellulose triacetate, polyvinylacetate, polycarbonate, polyethyline terephthalate, polystyrene and the like, and the most varied paper webs may be used with or without plastics coatings on their surfaces.

According to the present process, photographic layers may be applied which contain silver halides as photosensitive compounds, and those photographic layers may also be applied which contain photosensitive dyes or photoconductive zinc oxides and titanium dioxide. The layers may also contain additives other than those which are known in the production field of photographic layers, for example carbon black, matting agents, such as silicon dioxide or polymeric development auxiliaries and the like.

The photographic layers may also contain various hydrophilic colloids as binders. Examples of such colloids include, in addition to proteins, such as gelatine, cellulose derivatives, polysaccharides, such as starch, sugar, dextran or agar-agar. Synthetic polymers, such as polyvinyl alcohol or polyacrylamide or mixtures of such binders may also be used. Moreover, the coating process of the present invention may, of course, also be used for the production of non-photographic layers, for example, for the production of magnetone height to 110 mm did not provide any improvement in the casting quality.

A few possibilities of coatings will now be illustrated using Examples. The Examples are only a selection and thus can only provide a survey which makes no claim to completeness. The Tables illustrated in the following Examples use symbols which are defined as follows:

$\eta$ = viscosity [mPas]
$\sigma$ = surface tension [m N/m]
$\delta$ = wet application to the web [$\mu$m]
v = web speed [m/min]
h = height of curtain [mm].

EXAMPLE 1

A coating apparatus according to FIG. 1 was used as the caster for a two-layered casting. The casting data of the individual layers are as follows:

| | Photographic layer 4 | Photographic layer 2 |
|---|---|---|
| $\eta$ | 150 | 150 |
| $\sigma$ | 35.1 | 32.4 |
| $\delta$ | 40 | 40 |

A maximum casting rate of v = 150 m/min could be achieved. The casting quality was only satisfactory. The curtain height was 50 mm. An increase in the curtain emulsions.

EXAMPLE 2

A coating apparatus according to FIG. 1 was used as the caster for a two-layered casting, as in Example 1, with an additional accelerating and spreading layer. The casting data of the individual layers are as follows:

| | Accelerating layer | Photographic layer | Photographic layer | Spreading layer |
|---|---|---|---|---|
| $\eta$ | 2.5 | 150 | 150 | 9 |
| $\sigma$ | 30 | 35.1 | 32.4 | 29.8 |
| $\delta$ | 5 | 40 | 40 | 20 |

A casting rate of 400 m/min was achieved with a curtain height h of 50 mm. The casting quality was good.

EXAMPLE 3

A caster according to FIG. 2 was used as a beak caster for a four-layered casting. The casting data are stated in the following Table. A triacetate support was used as the support.

| | Layer 1 | Layer 2 | Layer 3 | Layer 4 |
|---|---|---|---|---|
| $\eta$ | 50 | as for 1 | as for 1 | as for 1 |
| $\sigma$ | 27.8 | | | |
| $\delta$ | 15 | | | |

The coating rate was 200 m/min and the curtain height h was 30 mm. The casting quality was satisfactory but the casting rate was unsatisfactory.

EXAMPLE 4

A caster according to FIG. 2 was used for a four-layered casting. An accelerating layer 7 was supplied from gap 9.1 to the curtain 12 at the coating edge 4. A PE paper support with a substrate layer was used as the support. The complete coating structure corresponded to that of Example 3, but in this Example, an accelerating layer was added. The casting data are stated in the following Table.

| | Accelerating Layer | Layer 1 | Layer 2 | Layer 3 | Layer 4 |
|---|---|---|---|---|---|
| $\eta$ | 2 | 50 | | | |
| $\sigma$ | 28 | 27.8 | as for | as for | as for |
| $\delta$ | 7 | 15 | layer 1 | layer 1 | layer 1 |

The coating rate was 400 m/min with a curtain height of 30 mm. The casting quality was very good and the curtain was stable. Whereas according to the process of Example 3, only an unsatisfactory coating was possible, in this case, a perfect coating could be achieved at a casting rate of 400 m/min, without reaching the limiting speed.

EXAMPLE 5

The caster according to FIG. 2 was used for a four-layered casting. A triacetate support was used as the support. An accelerating layer was again supplied from gap 9.1. The casting data are stated in the following Table.

| | Accelerating Layer | Layer 1 | Layer 2 | Layer 3 | Layer 4 |
|---|---|---|---|---|---|
| $\eta$ | 5 | 100 | | | |
| $\sigma$ | 30 | 27.8 | as for | as for | as for |
| $\delta$ | 7 | 25 | layer 1 | layer 1 | layer 1 |

The coating rate was 400 m/min with a curtain height of 15 mm. The casting quality was very good and the curtain was stable. This result was also most surprising, because without an external force influence (vacuum, pressure, or the like), the coating is possible with a stretching at the impact point by factor 14. The necessary stretching forces are transferred from the low viscosity thin accelerating layer to the coating materials.

EXAMPLE 6

A coating apparatus according to FIG. 2 was used as the caster for a two-layered casting with an accelerating layer and a spreading layer. The casting data of the individual layers are as follows:

| | Accelerating Layer | Photographic Layer | Photographic Layer | Spreading Layer |
|---|---|---|---|---|
| $\eta$ | 2.5 | 150 | 150 | 9 |
| $\sigma$ | 30 | 35.1 | 32.4 | 29.8 |
| $\delta$ | 6 | 20 | 20 | 10 |

It was possible to achieve a casting rate of above 400 m/min with a curtain height h of 15 mm. The casting quality was very good.

We claim:

1. A process for the multiple coating of objects or webs which are continuously moving past a coating point, using coating apparatus according to the curtain coating process, characterised in that any number of layers having a viscosity which is higher than a viscosity value of 20 mPas is embedded between a low-viscosity layer which is positioned below the layers and has a viscosity range of from 1 to 20 mPas and a layer thickness of from 2 to 30 $\mu$m, and a spreading layer which is positioned above the comparatively high viscosity layers and has a viscosity range of from 1 to 10 mPas and a layer thickness of from 5 to 20 $\mu$m.

2. A process according to claim 1, characterised in that a low-viscosity layer which has a viscosity of from 2 to 10 mPas, in particular from 2 to 3 mPas and a layer thickness of from 2.5 to 10 μm, in particular from 2.5 to 5 μm is selected.

3. A process according to claim 1, characterised in that the coating apparatus for the curtain coating process is a beak caster.

4. A process according to claim 1, characterised in that the coating apparatus for the curtain coating process is a V-caster.

5. A process according to claim 1, characterised in that the height h of the curtain between the coating edge and the surface of the object to be coated is from 10 to 100 mm, preferably from 15 to 50 mm.

6. A process for the multiple coating of objects or webs which are continuously moving past a coating point, using coating apparatus according to the curtain coating process, characterised in that below any number of layers having viscosity of 50 mPas or more, a layer is positioned having a viscosity range of from 1 to 20 mPas and a layer thickness of from 2 to 30 μm and forming the joinder between the high viscosity layers and the objects or webs to be coated.

7. A process according to claim 6, characterized in that the coating apparatus for the curtain coating process is a V-caster.

8. A process according to claim 6, characterized in that the number of high viscosity layers is embedded between the low viscosity layer and a spreading layer which is positioned above the high viscosity layers and has a viscosity range of from 1 to 10 mPas and layer thickness of from 5 to 20 μm.

9. A process according to claim 6, characterized in that a low-viscosity layer which has a viscosity of from 2 to 10 mPas, in particular from 2 to 3 mPas, and a layer thickness of from 2.5 to 10 μm, in particular from 2.5 to 5 μm, is selected.

10. A process according to claim 6, characterized in that the coating apparatus for the curtain coating process is a beak caster.

11. A process according to claim 7, characterized in that the low-viscosity layer flows from one side of the V-caster and the package of other layers flow from the opposite side of the V-caster for joining together when forming the free-falling curtain.

12. A process according to claim 6, characterized in that the height h of the curtain between the coating edge and the surface of the object to be coated is from 10 to 100 mm, preferably from 15 to 50 mm.

* * * * *

UNITED STATES PATENT AND TRADEMARK OFFICE

CERTIFICATE OF CORRECTION

PATENT NO. : 4,569,863

DATED : February 11, 1986

INVENTOR(S) : Gunther Koepke, et al.

It is certified that error appears in the above-identified patent and that said Letters Patent is hereby corrected as shown below:

Column 4, line 5, "mPa.s" should read -- mPas --

Column 5, line 56, "advantagouesly" should read -- advantageously --

Column 7, line 16, "Photographic layer 4" should read -- Photographic layer 1 --

Signed and Sealed this

Tenth Day of October, 1989

*Attest:*

DONALD J. QUIGG

*Attesting Officer*

*Commissioner of Patents and Trademarks*